US005308976A

United States Patent [19]

Misawa et al.

[11] Patent Number: 5,308,976

[45] Date of Patent: May 3, 1994

[54] METHOD FOR MULTI-BEAM MANIPULATION OF MICROPARTICLES

[75] Inventors: Hiroaki Misawa, Osaka; Keiji Sasaki, Kyoto; Nobura Kitamura, Kyotoa, all of Japan

[73] Assignee: Research Development Corp. of Japan, Tokyo, Japan

[21] Appl. No.: 891,175

[22] Filed: May 29, 1992

[30] Foreign Application Priority Data

Jun. 1, 1991 [JP] Japan ..... 3-130106

[51] Int. Cl.[5] ..... H05H 3/04

[52] U.S. Cl. ..... 250/251

[58] Field of Search ..... 250/251

[56] References Cited

U.S. PATENT DOCUMENTS

| | | | |
|---|---|---|---|
| 4,023,158 | 5/1977 | Corcoran | 250/251 |
| 5,170,890 | 12/1992 | Wilson et al. | 250/251 |
| 5,206,504 | 4/1993 | Sridharan | 250/251 |
| 5,212,382 | 5/1993 | Sasaki et al. | 250/251 |

*Primary Examiner*—Jack I. Berman

*Attorney, Agent, or Firm*—Wenderoth, Lind & Ponack

[57] ABSTRACT

Irradiating a plurality of laser beams onto different microparticles or different groups of microparticles, and trapping and/or manipulating these microparticles or groups of microparticles. This method permits manipulation of microparticles with a plurality of trapping laser beams not mutually interfering just as with two human hands. By coaxially introducing an excited laser beam, it is possible to induce chemical reactions for processing or assembling.

3 Claims, 4 Drawing Sheets

FIG. 4a
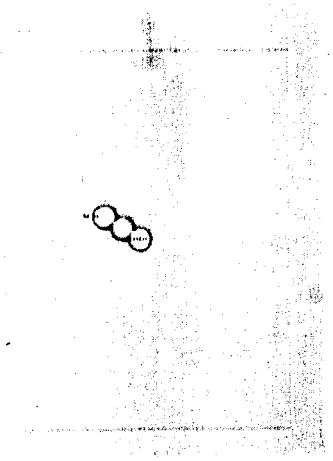
FIG. 4b
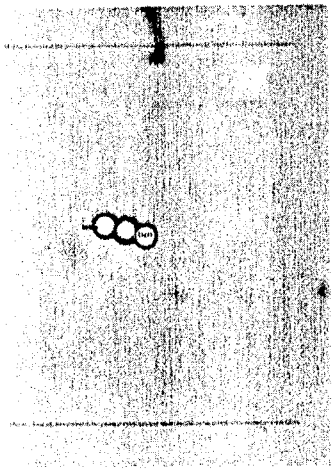
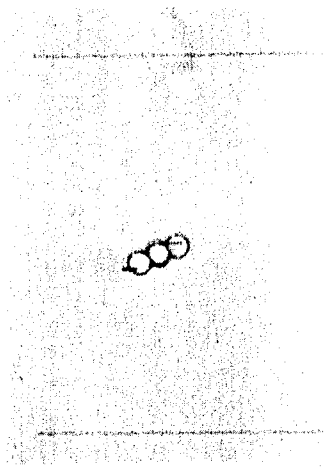
FIG. 4c
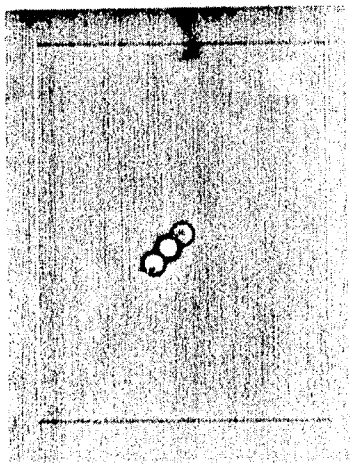
FIG. 4d

METHOD FOR MULTI-BEAM MANIPULATION OF MICROPARTICLES

FIELD OF THE INVENTION

The present invention relates to a method for multi-beam manipulation of microparticles. More particularly, the present invention relates to a method for multi-beam manipulation of microparticles which is useful in such various fields as bioengineering and chemistry, and permits free non-contact manipulation of multiple kinds of microparticles of the micrometer order.

PRIOR ART

There has conventionally been known the laser trapping method comprising trapping microparticles of the micrometer order with a laser beam, and expectation is entertained to apply this technology for cell manipulation in the field of bioengineering and for quality improvement and reactions of microparticles in the field of chemistry.

Regarding this laser trapping, the present inventors have proposed a few other methods representing the progress of micromanipulation technology, which are epoch-making methods useful in the formation of a dynamic pattern with a group of microparticles, microprocessing of microparticles, and manipulation of metal microparticles (Japanese Patent Application No. 1-318,258, Japanese Patent Application No. 2-78,421, Japanese patent Application No. 2-402,063, and Japanese Patent Application No. 3-104,517).

With these methods, it is now possible to manipulate trapping, transfer and processing of a microparticle or a group of microparticles in non-contact manner and at will.

In spite of this progress of micromanipulation technology based on laser beam, however, a method has not as yet been established, which permitted individual manipulation of a plurality of microparticles. This has formed an obstacle for the expansion of the scope of application of laser scanning.

In view of the circumstances described above, the present invention has an object to provide a new method which solves the problems in the conventional methods as described above and permits trapping, processing and assembling of even a plurality of microparticles or groups of microparticles.

SUMMARY OF THE INVENTION

The present invention provides, as a means to solve the above-mentioned problems, a method for multi-beam manipulation of microparticles, which comprises the steps of irradiating a plurality of laser beams onto different microparticles or different groups of microparticles and trapping and/or manipulating said microparticles or said groups of microparticles.

Embodiments of the present invention include splitting a single laser beam and irradiating same after coaxialization, and polarizing a laser beam, splitting same with a polarized beam splitter, and irradiating the resultant plurality of beams after coaxialization.

BRIEF DESCRIPTION OF THE DRAWINGS

FIG. 4*a–d* are a plan view illustrating further another typical manipulation of microparticles according to the present invention.

DETAILED DESCRIPTION OF THE INVENTION

The present invention provides a method for multi-beam manipulation of microparticles. The method comprises the steps of irradiating a plurality of laser beam onto different microparticles or different groups of microparticles and trapping and/or manipulating said microparticles or said groups of microparticles.

The method of multibeam manipulation of microparticles of the present invention will now describe further in detail with reference to some examples.

Figure 1:
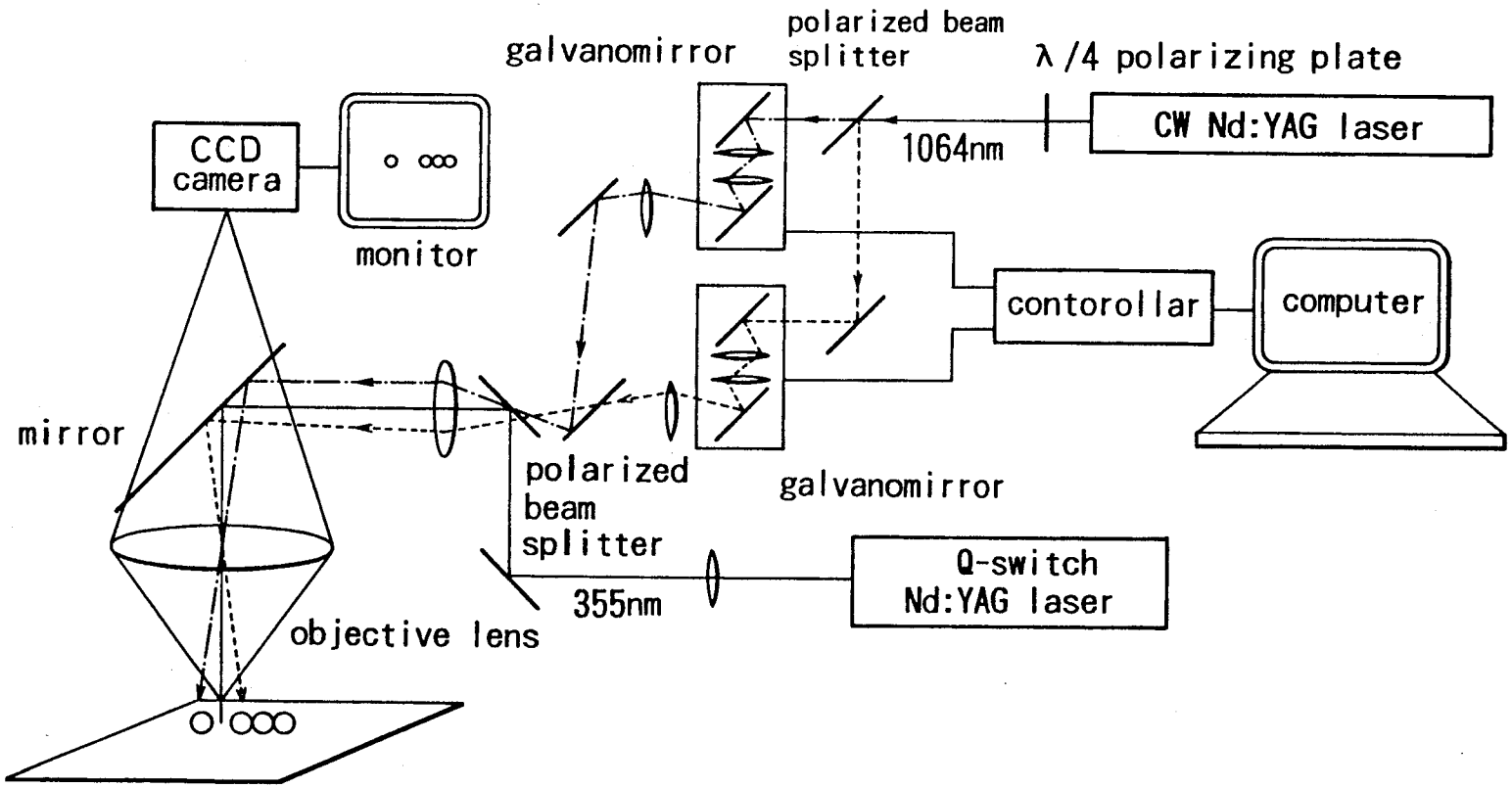
FIG. 1 is a block diagram illustrating a typical system configuration applicable in the present invention.

Configuration of a system applicable in the method of the present invention is shown in FIG. 1. In this embodiment, a laser beam for trapping CWND: YAG (Spectron SL902T; wavelength; 1,064 nm; linear polarization) is employed. This laser beam is converted into a circular polarized beam with a $\lambda/4$ plate, and the resultant polarized beam is split into two beams by means of a polarized beam splitter. The two split laser beams are individually deflected in two axial directions with two galvanomirrors (GSZ Q325DT), then coaxialized with the polarized beam splitter. As the two beams, of which the polarization directions are at right angles to each other, are characterized by the absence of mutual interference (the intensity distribution does not vary with the relative positions of the beams). These laser beams are directed to a microscope (Nikon Uptiphot XF) via a lens system, and condensed onto a sample through an oil-impregnated objective lens ($\times 100$, NA$=1.30$). The condensing spot has a size of 1 $\mu$m. The galvanomirrors are located at the opening and at the image forming positions of the microscope, respectively. Under the effect of deflection caused by the galvanomirrors, the focal position scans the sample two-dimensionally. The galvanomirrors are controlled by a computer (NEC PC9801 RA): it is possible to move the two beams at will by the operation of keyboard. Laser scanning makes it possible to align a plurality of microparticles with each beam, and even to trap metal microparticles or low-refraction microparticles. Any cause of laser scanning can freely be set through keyboard input. For an excited laser beam, on the other hand, a Q-switch YAG laser (wavelength: 355 nm; pulse width: approx. 30 ps) is used, and is condensed on the sample in coaxialization with the trapping laser beam. The progress of microparticle manipulation is observed through a CCD camera and a video recorder. The position of the laser beam and the current status of manipulation are displayed in a superimposed manner of the monitor screen.

Now let use see an example in which, by the use of the above-mentioned system configuration, micromanipulation was carried out with a sample prepared by dispersing monodispersive polystylene microparticles having a diameter of 3 $\mu$m in ethylene glycol containing acrylic acid (monomer), N,N'-methylenebisacryl amid (linking agent) and DALOCURE 1116 (photo-polymerization initiator) dissolved therein.

Example of Manipulation

Figure 2:
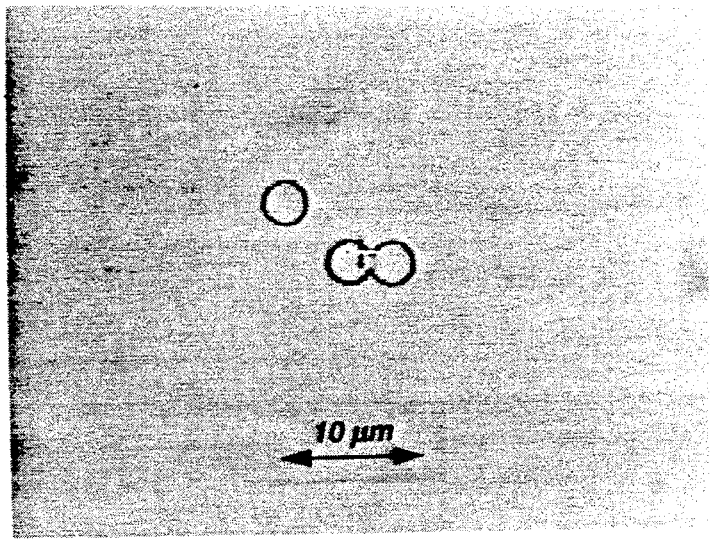
FIG. 2 is a plan view illustrating a typical manipulation of microparticles according to the present invention.
Figure 3:
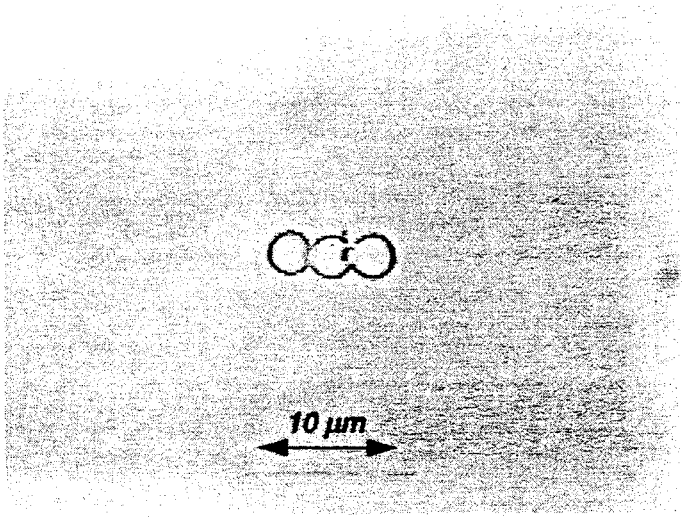
FIG. 3 is a plan view illustrating another typical manipulation of microparticles according to the present invention.

First, as shown in FIG. 2, polystylene latex microparticles of the above-mentioned sample are trapped with two individual beams, and are caused to come into contact with each other by moving the beams. Then, an excited laser is irradiated onto the contact point to cause photo-polymerization to start. A few seconds after laser irradiation, acrylic acid gel is generated on the surfaces of the polystylene microparticles, thus causing welding of two microparticles. After confirming welding by moving the beams, laser scanning of one of the beams is started to trap connected microparticles. Then, as shown in FIG. 3, the other beam traps the other microparticle while moving, and is caused to move to an arbitrary position of the two connected microparticles for contact thereof. The excited laser is irradiated onto the contact point in the same manner as above to repeat welding through photo-polymerization. Repetition of this cycle of manipulation permits building a structure based on microparticles.

Then, for the purpose of causing a rotary motion of this microparticle structure, as shown in FIG. 4, (a) first, laser scanning is discontinued to trap two arbitrary points on the structure; (b) one of the beams is fixed so as to serve as the rotation axis; and (c) the other beam is caused to start circular scanning around the fixed rotation axis as the center of rotation. Then, the microstructure begins rotary motion.

It is needless to mention that any of various laser beam optical systems may be adopted in the manipulation as described above, and any of various organic, inorganic and metal microparticles may be covered in addition to organic polymers. A biological sample such as a living cell may also be used.

This method permits manipulation of microparticles with two trapping laser beams not mutually interfering just as with two human hands. Manipulation is fully controllable by a computer. By coaxially introducing an excited laser beam, furthermore, it is possible to induce chemical reactions for processing or assembling.

According to the method for micromanipulation of the present invention using a plurality of laser beams, it is possible to conduct processing, assembling or a mechanical motion of a plurality of microparticles or a plurality of groups of microparticles. This method is not only directly applicable in the form of an assembling or driving apparatus of a micromachine, but also permits construction and control of a microstructure of the micrometer order important physics, chemistry, mechanical engineering and electrical engineering.

What is claimed is:

1. A method for multi-beam manipulation of microparticles, which comprises the steps of (a) a first step of irradiating a plurality of laser beams onto microparticles for individually trapping said microparticle(s), (b) a second step of bringing the trapped microparticle(s) into contact with other trapped microparticle(s) by scanning the laser beams, and (c) a third step of irradiating an excited laser beam onto the contact area of the trapped microparticles to cause photoreaction of the microparticles.

2. A method for multi-beam manipulation of microparticles as claimed in claim 1, wherein in said first step the plurality of beams is produced by dividing a single beam and coaxializing the thus divided beams for irradiation.

3. A method for multi-beam manipulation of microparticles as claimed in claim 1, wherein laser beam is polarized and split to produce a plurality of beams by means of a polarized beam splitter, the plurality of beams are then coaxialized and a plurality of coaxialized beams are irradiated onto the microparticles.

* * * * *